US011859266B2

(12) United States Patent
McCall et al.

(10) Patent No.: US 11,859,266 B2
(45) Date of Patent: Jan. 2, 2024

(54) CASTABLE HIGH TEMPERATURE NICKEL-RARE EARTH ELEMENT ALLOYS

(71) Applicants: Lawrence Livermore National Security, LLC, Livermore, CA (US); Eck Industries, Inc., Manitowoc, WI (US); Iowa State University Research Foundation, Inc., Ames, IA (US); University of Tennessee Research Foundation, Knoxville, TN (US); UT-Battelle, LLC, Oak Ridge, TN (US)

(72) Inventors: Scott K. McCall, Livermore, CA (US); Alexander Baker, Pleasanton, CA (US); Hunter B. Henderson, Livermore, CA (US); Tian Li, Pleasanton, CA (US); Aurelien Perron, Pleasanton, CA (US); Zachary Cole Sims, Knoxville, TN (US); David Weiss, Manitowoc, WI (US); Ryan T. Ott, Ames, IA (US); Orlando Rios, Knoxville, TN (US); Max Neveau, Knoxville, TN (US)

(73) Assignees: Lawrence Livermore National Security, LLC, Livermore, CA (US); Eck Industries, Inc., Manitowoc, WI (US); Iowa State University Research Foundation, Inc., Ames, IA (US); University of Tennessee Research Foundation, Knoxville, TN (US); UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 17/681,424

(22) Filed: Feb. 25, 2022

(65) Prior Publication Data

US 2022/0275483 A1 Sep. 1, 2022

Related U.S. Application Data

(60) Provisional application No. 63/154,397, filed on Feb. 26, 2021.

(51) Int. Cl.

| | |
|---|---|
| ***C22C 19/05*** | (2006.01) |
| ***C22C 19/03*** | (2006.01) |
| ***C22C 1/02*** | (2006.01) |

(52) U.S. Cl.

CPC ..... *C22C 19/055* (2013.01); *C22C 1/023* (2013.01)

(58) Field of Classification Search

CPC ..... C22C 19/05; C22C 19/007; C22C 19/03; C22C 19/055; C22F 1/10

See application file for complete search history.

(56) References Cited

U.S. PATENT DOCUMENTS 3,189,445 A * 6/1965 Calkins ..... C22C 19/007 420/455

6,343,641 B1 * 2/2002 Gigliotti, Jr. ..... B22D 21/025 164/128

FOREIGN PATENT DOCUMENTS

EP 107508 A * 5/1984 ..... C22C 19/05

OTHER PUBLICATIONS

Rare Element Resources, "Rare Earth Elements," Rare Element Resources Ltd., 2016, 3 pages, retrieved from http://www.rareelementresources.com/rare-earth-elements#.YCWn8mhKiu0.

* cited by examiner

*Primary Examiner* — Jessee R Roe

(74) *Attorney, Agent, or Firm* — Zilka-Kotab, P.C.

(57) ABSTRACT

A product includes a material having: nickel and at least one rare earth element. The at least one rare earth element is present in the material in a weight percentage in a range of about 2% to about 20% relative to a total weight of the material. A method includes forming a material comprising an alloy of nickel and at least one rare earth element. The at least one rare earth element is present in the material in a weight percentage in a range of about 2% to about 20% relative to a total weight of the material.

22 Claims, 8 Drawing Sheets

CASTABLE HIGH TEMPERATURE NICKEL-RARE EARTH ELEMENT ALLOYS

RELATED APPLICATIONS

This application claims priority to Provisional U.S. Appl. No. 63/154,397 filed on Feb. 26, 2021, which is herein incorporated by reference.

This invention was made with Government support under Contract No. DE-AC52-07NA27344 awarded by the United States Department of Energy. The Government has certain rights in the invention.

FIELD OF THE INVENTION

The present invention relates to rare earth elements, and more particularly, this invention relates to castable high temperature nickel-rare earth element alloys.

BACKGROUND

Complex parts for use at high temperatures are in high demand for applications such as heat exchangers, turbine blades, gas turbines, etc. Many of these applications are conventionally addressed with nickel-based (Ni-based) superalloys such as Inconel® alloys or Hastalloys®. The foregoing alloys are optimized for corrosion resistance, creep strength, and fracture toughness. However, these alloys are less machinable than typical steels and complicated parts are more difficult to produce and often require joining. The composition of these alloys often include expensive constituents.

SUMMARY

A product, according to one general embodiment, includes a material having: nickel and at least one rare earth element. The at least one rare earth element is present in the material in a weight percentage in a range of about 2% to about 20% relative to a total weight of the material.

A method, according to another general embodiment, includes forming a material comprising an alloy of nickel and at least one rare earth element. The at least one rare earth element is present in the material in a weight percentage in a range of about 2% to about 20% relative to a total weight of the material.

Other aspects and advantages of the present invention will become apparent from the following detailed description, which, when taken in conjunction with the drawings, illustrate by way of example the principles of the invention.

DETAILED DESCRIPTION

Figure 1:
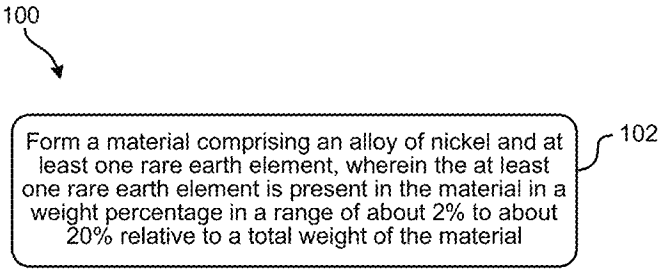
FIG. 1 is a flowchart of a method, in accordance with one aspect of the present invention.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of castable high temperature nickel-rare earth element alloys.

In one general embodiment, a product includes a material having nickel and at least one rare earth element. The at least one rare earth element is present in the material in a weight percentage in a range of about 2% to about 20% relative to a total weight of the material.

In another general embodiment, a method includes forming a material comprising an alloy of nickel and at least one rare earth element. The at least one rare earth element is present in the material in a weight percentage in a range of about 2% to about 20% relative to a total weight of the material.

Conventional materials used for high temperature application tend to be expensive, difficult to reliably form into products, and suffer from degradation. For example, high temperature heat exchangers require a large number of manufacturing steps, complex designs, welding, etc. To reduce the cost and complexity of manufacturing heat exchangers and other devices for high temperature applications, nickel-rare earth element (REE) alloys, as presented herein, were developed as a less expensive alternative to standard high temperature and pressure materials. The Ni-REE alloys as described herein provide competitive and improved performance compared to existing Ni-based superalloys for a plethora of uses and applications.

Incorporating overproduced and underutilized rare earth elements, particularly lanthanum (La) and cerium (Ce), reduces the cost of the alloy while improving the mechanical properties over Ni-based superalloys. For example, cerium is heavily present in rare earth element-producing mines, but cerium conventionally has had low economic value and limited usability. Ni-REE alloys using these overproduced rare earth elements, as discussed in accordance with some aspects of the present disclosure, provide the benefit of increasing the maximum service temperature above that of conventional Ni-based superalloys while reducing the cost and difficulty of manufacturing these materials.

Ni-REE alloys as presented herein are characterized as having thermal stability up to 0.8 homologous temperature and the Ni-REE alloys retain greater than 50% of the respective alloy's mechanical properties at 1000° C. (e.g., yield strength) relative to the alloy at room temperature. In a distinct and/or inclusive example the said alloy retains 60% of the material's mechanical properties after exposure to 1000° C. for 100 hrs. In the example, the alloy does not exhibit a microstructural coarsening greater that 30% the mean particle. Solubility is a key factor in microstructural thermal stability and is proportional to a decreased coarsening rate. In the case of Ni—Ce alloys, solubility of Ce in pure Ni is 0.016 atomic percent at 1200° C., which is orders of magnitude less than other standard alloying elements. Additionally, alloying Ni—Ce with standard nickel-based superalloy components improves high temperature properties, such as creep resistance, and expands the alloys' application space. Furthermore, this set of alloys does not necessarily require the expensive single crystal growth methods of the most advanced nickel-based alloys employ for targeted properties.

Previous work on Al—Ce alloys has shown property retention values, which when translated to Ni—Ce, would result in an 80% mechanical retention (e.g., retention of room temperature strength) after 800° C. exposure for 100 hours, and/or 70% retention at an environmental temperature of 800° C. depending on the composition. The presently disclosed alloy design strategy takes advantage of "kinetically trapped" microstructures, which form directly from a melt, and remain stable after long periods of thermal exposure and/or thermal cycling.

FIG. 1 shows a method 100, in accordance with one embodiment. As an option, the present method 100 may be implemented to construct structures, devices, products, etc., such as those shown in the other FIGS. described herein. Of course, however, this method 100 and others presented herein may be used to form structures for a wide variety of devices and/or purposes described herein which may or may not be related to the illustrative embodiments listed herein. Further, the methods presented herein may be carried out in any desired environment. Moreover, more or less operations than those shown in FIG. 1 may be included in method 100, according to various embodiments. It should also be noted that any of the aforementioned features may be used in any of the embodiments described in accordance with the various methods.

Method 100 includes operation 102. Operation 102 includes forming a material comprising an alloy of nickel and at least one rare earth element. The rare earth element is present in the material in a weight percentage in a range of about 2% to about 20% relative to a total weight of the material. Rare earth elements as referred to herein may include scandium (Sc), yttrium (Y), lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

Other rare earth elements (REE), and any combination thereof, are considered as isomorphic with Ce, and such REE and/or REE combinations may be used with and/or in place of Ce in any of the various alloys described herein. Thus, the mention of Ce, and/or use of any particular Ce wt. % herein can be considered as referring to pure Ce, a different pure REE such as La or Nd, or an admixture of two or more REE that combines to the stated value at any ratio.

Natural mischmetal comprises, in terms of weight percent, about 50% cerium, 30% lanthanum, with the balance being other rare earth elements. Thus, modification of Ni alloys with cerium through the addition of mischmetal may be a less expensive alternative to pure cerium.

In addition to the development of two component NiCe alloys, adding REE components to other nickel-based alloys and super alloys, such as Ni-alloys containing aluminum, titanium, chromium, niobium, and molybdenum, improves the desirable properties of such super alloys, and expands the alloys' application space.

Figure 2:
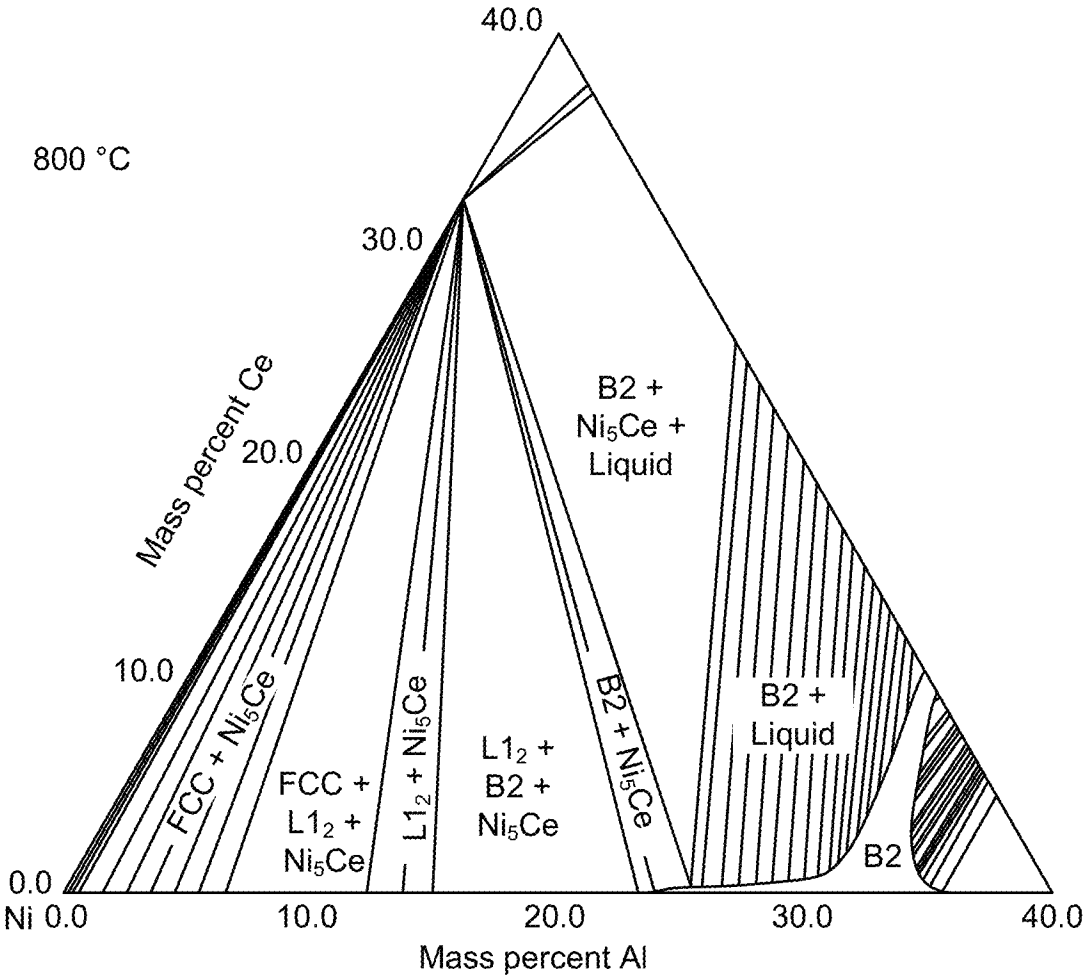
FIG. 2 is an Ni—Ce—Al isothermal phase diagram at 800° C.
Figure 3:
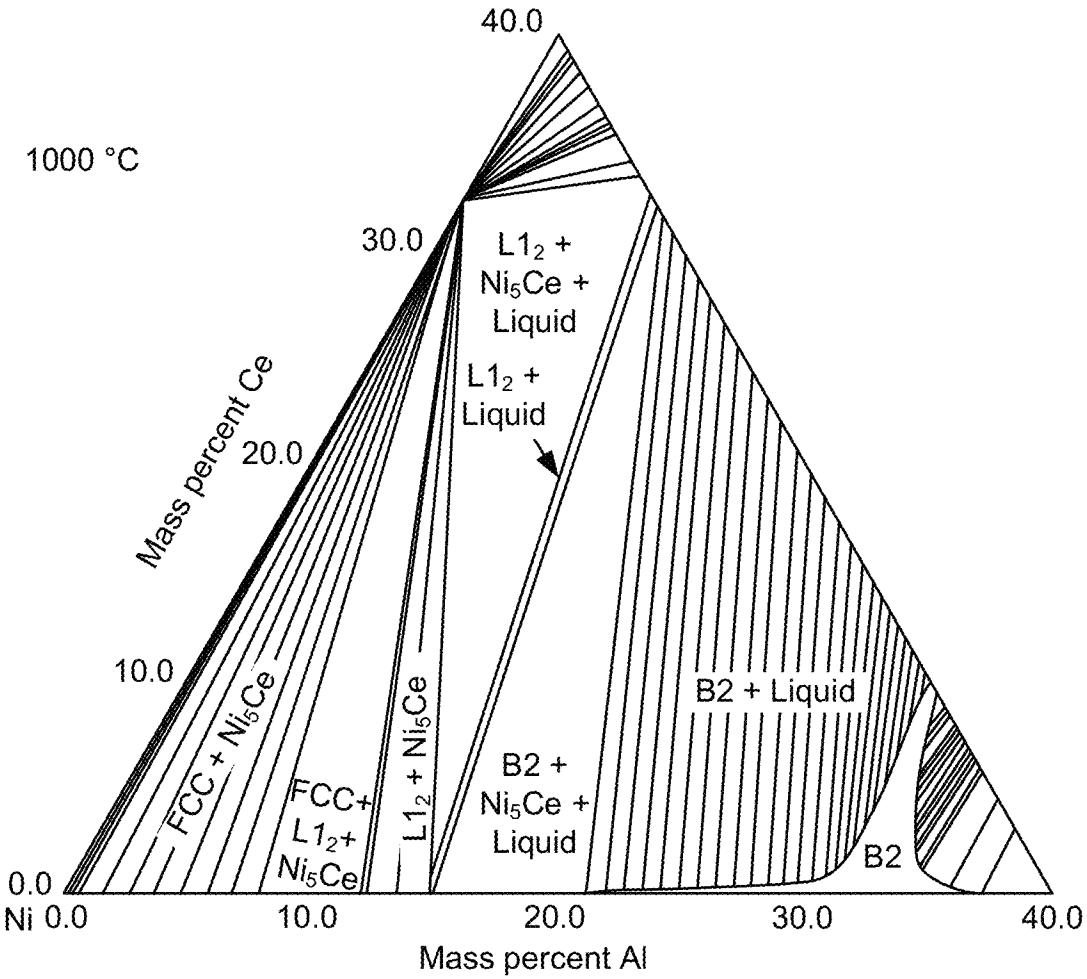
FIG. 3 is an Ni—Ce—Al isothermal phase diagram at 1000° C.
Figure 4:
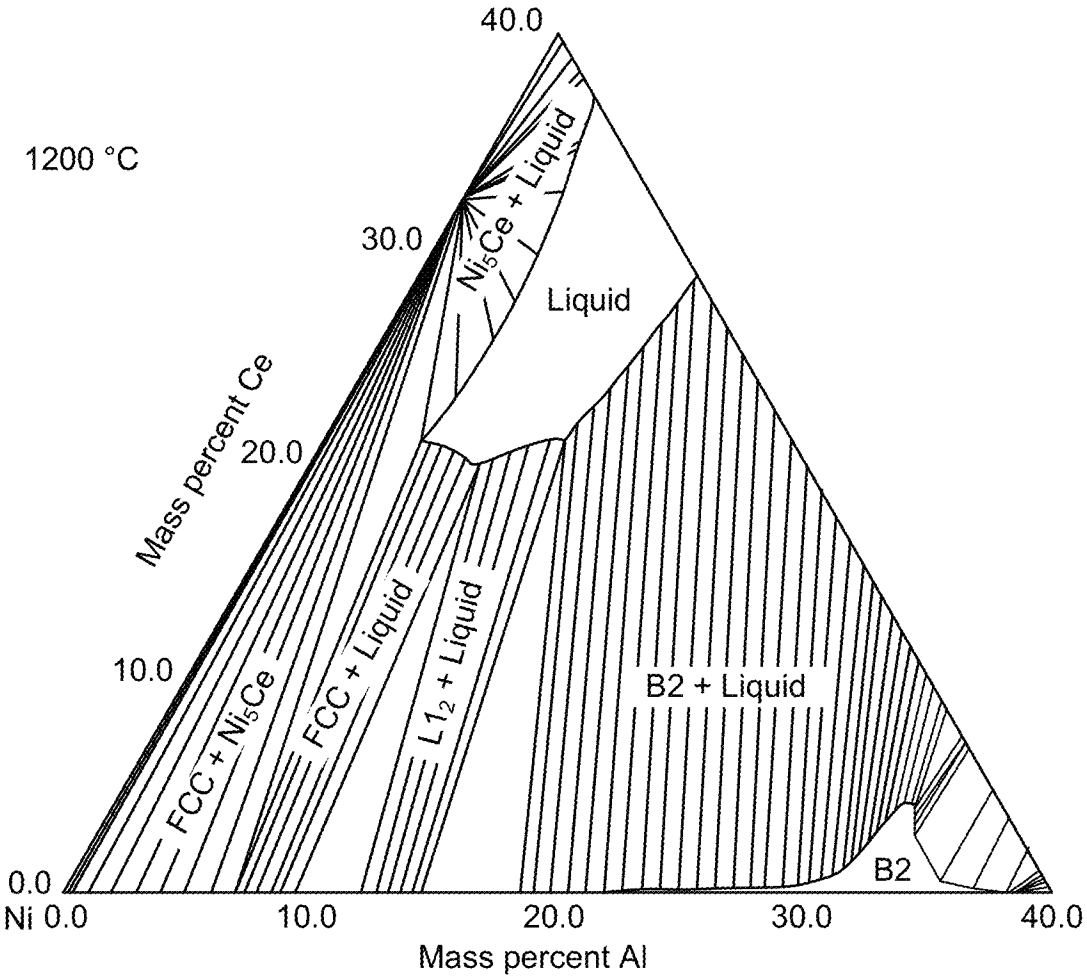
FIG. 4 is an Ni—Ce—Al isothermal phase diagram at 1200° C.

Following are several exemplary Ni-REE alloys, as well as Ni-REE alloys that include one or more additional alloying elements. Additions of the following alloying elements (in weight %) are included using the Ni—Ce eutectic point as a base and improving mechanical properties with solid-solution strengthening and the formation of carbides, the gamma prime phase, the gamma double prime phase, and others. For instance, FIGS. 2, 3, and 4 show isothermal phase diagrams of the Ni—Ce—Al at 800° C., 1000° C., and 1200° C., respectively, as constructed from a proprietary CALPHAD database. The diagrams indicate regions in which gamma prime (noted as $L1_2$ in the diagrams) may be formed through a precipitation reaction in the presence of $Ni_5Ce$ phase. In various approaches, the material is characterized as having a structure including a gamma prime phase characteristic of a reaction (e.g., physically characterized by the reaction) of the nickel with aluminum and/or titanium. The resulting gamma prime phase is in a phase mol % in a range of about 0.5 mol % to about 15 mol % of the material.

Additional alloying elements may be selectable by one having ordinary skill in the art based at least in part on the intended use of a product comprising the Ni-REE alloy material. For example, aluminum may be used in the Ni-REE alloy for increasing oxidation resistance (e.g., corrosion resistance) and increasing performance of the material, especially at higher temperatures.

Having Ni as the balance, a Ni-REE alloy may have a composition of Ce, Yttrium (Y), and/or any other rare earth element in a cumulative weight % of the bulk composition in a range of about 2% to about 20%. Having Ni as the balance, a material comprising a Ni-REE alloy may have a composition of iron (Fe) in weight % of the bulk composition in a range of greater than 0% and less than or equal to about 40%. Having Ni as the balance, a material comprising a Ni-REE alloy may have a composition of chromium (Cr) in weight % of the bulk composition in a range of greater than 0% and less than or equal to about 22%. Having Ni as the balance, a material comprising a Ni-REE alloy may have a composition of cobalt (Co) and/or platinum (Pt) in weight % of the bulk composition in a range of greater than 0% and less than or equal to about 18%. Having Ni as the balance, a material comprising a Ni-REE alloy may have a composition of titanium (Ti), vanadium (V), and/or molybdenum (Mo) in weight % of the bulk composition in a range of greater than 0% and less than or equal to about 8%. Having Ni as the balance, a material comprising a Ni-REE alloy may have a composition of aluminum (Al) in weight % of the bulk composition in a range of greater than 0% and less than or equal to about 10%. In other approaches, having Ni as the balance, a material comprising a Ni-REE alloy may have a composition of aluminum (Al) in weight % of the bulk composition in a range of greater than or equal to 2% and less than or equal to about 15%. Having Ni as the balance, a material comprising a Ni-REE alloy may have a composition of niobium (Nb), manganese (Mn), tungsten (W), tantalum (Ta), rhenium (Re), or ruthenium (Ru) in weight % of the bulk composition in a range of greater than 0% and less than or equal to about 6%. Having Ni as the balance, a material comprising a Ni-REE alloy may have a composition of carbon (C) in weight % of the bulk composition in a range of greater than 0% and less than or equal to about 0.2%. Having Ni as the balance, a material comprising a Ni-REE alloy may have a composition of boron (B), hafnium (Hf), zirconium (Zr), or scandium (Sc) in weight % of the bulk composition in a range of greater than 0% and less than or equal to about 2%. These compositions are exemplary and one having ordinary skill in the art would appreciate that a material comprising nickel and a rare earth element may comprise at least one rare earth element, at least two rare earth elements, or any combination of rare earth elements according to various approaches disclosed herein. In various approaches, a material comprises nickel and a plurality of rare earth elements. In other approaches, a material may comprise nickel, at least one rare earth element, and at least one additional element described herein. In various approaches, a weight % of any of the foregoing materials may be determinable in view of the matrix phase selection, the eutectic point, the coupled growth mechanism, etc. According to various approaches, the bulk composition refers to the bulk composition of the material (e.g., relative to the total weight of the material). For example, the material may comprise greater than 0% to about 40% iron (Fe) relative to a total weight of the material (e.g., the material may comprise iron (Fe) in weight % of the bulk composition of the material in a range of greater than 0% and less than or equal to about 40%).

Various approaches include forming the material comprising nickel and at least one rare earth element. When selecting the rare earth element, one having ordinary skill in the art may consider the solubility of the rare earth element in the nickel for the intended application, where the solubility improves the production of intermetallics which add strength to the material.

In various approaches, forming the material comprising nickel and at least one rare earth element includes heating the nickel and rare earth element(s) constituents to a range from about 1100° C. to about 2000° C. In at least some approaches, the constituents of the material are heated to a temperature at which the constituents substantially form a liquified alloy product comprising each of the constituents. A product of the material comprising nickel and the at least one rare earth element may be formed through casting techniques (including sand casting, investment casting, directional solidification, single crystal solidification, etc.), spray depositions techniques, powder consolidation, sintering, rapid solidification techniques (including laser or electron beam additive manufacturing, selective laser melting, directed energy deposition (DED), gas atomization, etc.), wrought techniques (including extrusion, forging, etc.), etc. With a thermal gradient sufficient to produce a coupled growth morphology with features less than 25 μm internal spacing, casting may include any of sand casting, loam molding, plaster mold casting, shell molding, investment casting, waste molding of plaster, evaporative-pattern casting, lost-foam casting, full-mold casting, non-expendable mold casting, permanent mold casting, die casting, semi-solid metal casting, centrifugal casting, continuous casting, etc. In other approaches, a method for forming the material comprising nickel and at least one rare earth element includes powder consolidation and/or extrusion techniques. In some approaches, a method for forming the material comprising nickel and the rare earth element includes creating wires, e.g., by drawing a wire. In any of the approaches disclosed herein, and/or when using forming techniques known in the art, the processing parameters of the selected process or technique may be selected and/or modified to have a distributed heterogenous inoculation to result in distributed fine strictures with less than 30 nm spacing on the sub mesoscale and less than 50 μm on the microscale, in a manner that would become apparent to one having ordinary skill in the art upon reading the present disclosure, in order to form the relatively finer morphologies of the material as described herein.

In at least some approaches, the material comprising nickel and at least one rare earth element may be deposited as a coating using coating techniques known in the art (e.g., thermal spray, cold spray, physical vapor deposition, pack cementation, etc.). The material may be used in bond coating applications, in at least one aspect, for improved adhesion to oxides and/or as a thermal barrier coating.

In some aspects, the material comprising nickel and at least one rare earth element may be deposited onto a substrate. The substrate may be flexible or rigid, depending on the intended application. The substrate may be part of the final component for which the material is used. In other approaches, the substrate may be sacrificial, and the material removed therefrom before use in various intended applications.

In at least some approaches, as the material comprising the nickel and the at least one rare earth element is cooled, a coupled growth mechanism produces a morphology characterized by having rods (e.g., dendrites) and spacing therein (e.g., interdendritic spacing). The spacing between the formed dendrites in the microstructure may vary with the cooling rate. In various approaches, the cooling rate may about 100° C./s. In preferred approaches, the cooling rate may be less than about 500 K/s (e.g., as for casting variations). In other approaches, the cooling rate may be greater than about 500 K/s (e.g., as for rapid solidification variations). In other approaches, the rate cooling rate may be between about $10^4$ and about $10^{8\circ}$ C./s. For example, the faster the cooling rate, the finer the features (e.g., the morphology) of the microstructures in the material. In various approaches, the material may be cooled using metallic chill techniques, thermal reservoirs, etc.

The material comprising nickel and at least one rare earth element is preferably characterized by having an intermetallic phase which remains substantially the same throughout thermal cycling of the material. For example, the material is characterized as having a stable microstructure which remains substantially unchanged throughout relatively faster and/or relatively slower thermal cycling processes. In one exemplary aspect, the material comprising nickel and at least one rare earth element is characterized by having an intermetallic phase which remains substantially the same after a temperature change of between about 25° C. and about 800° C., for more than about 100 cycles. In various aspects, the microstructures of the material remain substantially stable following long periods of thermal exposure and thermal cycling where the microstructures are "kinetically trapped." Kinetically trapped microstructures as described herein refer to Ni-REE-based intermetallic located between the nickel dendrites. The material characterized by these microstructure patterns is resistant to thermal coarsening due to a very low solubility for Ce in the Ni matrix. Coarsening as used in accordance with some aspects of the present disclosure may generally refer to the growth of particles and/or grains in the microstructure of the material, primarily driven by minimization of interfacial energy. In stark contrast, other nickel-based superalloys are characterized has having relatively more mobility in the microstructures which tend to coarsen throughout thermal cycling processes.

In various approaches, the average size of the domains (e.g., the spacing between the dendrites, the outer portions of the domains being defined by the interdendritic regions, wherein an average local microstructural length scale is up to about 1 micron in at least one dimension) is in the range of about 1 micron to about 30 microns in at least one dimension. In some approaches, the average diameter of the dendrites in the microstructure of the Ni-REE material is about 100 nanometers, or less, in at least one dimension. The characteristic dendrites and spacing of the microstructures of the material comprising nickel and the at least one rare earth element, in combination with the stability of the microstructures, provide improved mechanical properties which make the material attractive for several high temperature applications. Any "average" described herein refers to an "average" as measured by American Society for Testing and Materials (ASTM) standard.

In various aspects, the material is characterized as having cellular dendrites. In this context, cellular dendrites are characterized by highly directional columns of FCC matrix separated by intercellular regions that include Ni-REE-based intermetallic, and are a physical characteristic resulting from rapid solidification techniques. The interdendritic regions (e.g., the spacing between the directional cellular dendrites) have an average spacing of about 0.05 microns to about 2 microns in at least one direction. For example, formation of the Ni-REE alloy via rapid solidification techniques may result in an average spacing in the foregoing range. In at least some optional aspects, formation of the Ni-REE alloy via rapid solidification results in an average spacing of about 0.05 microns to about 0.5 microns. In other aspects, the interdendritic regions have an average spacing of about 0.5 microns to about 30 microns in at least one direction, with or without significant directionality. For example, formation of the Ni-REE alloy via conventional casting techniques may result in an average spacing in the foregoing range. In yet further approaches, the material may comprise disconnected rare-earth-containing intermetallic particles in the material and the average particle spacing is in a range of about 0.05 microns to about 5 microns. For example, formation of the Ni-REE alloy via wrought variations described herein may result in the foregoing average particle spacing range. In at least some optional aspects, formation of the Ni-REE alloy via conventional casting techniques results in an average spacing of about 2 microns to about 20 microns.

Experimental Results

Figure 5:
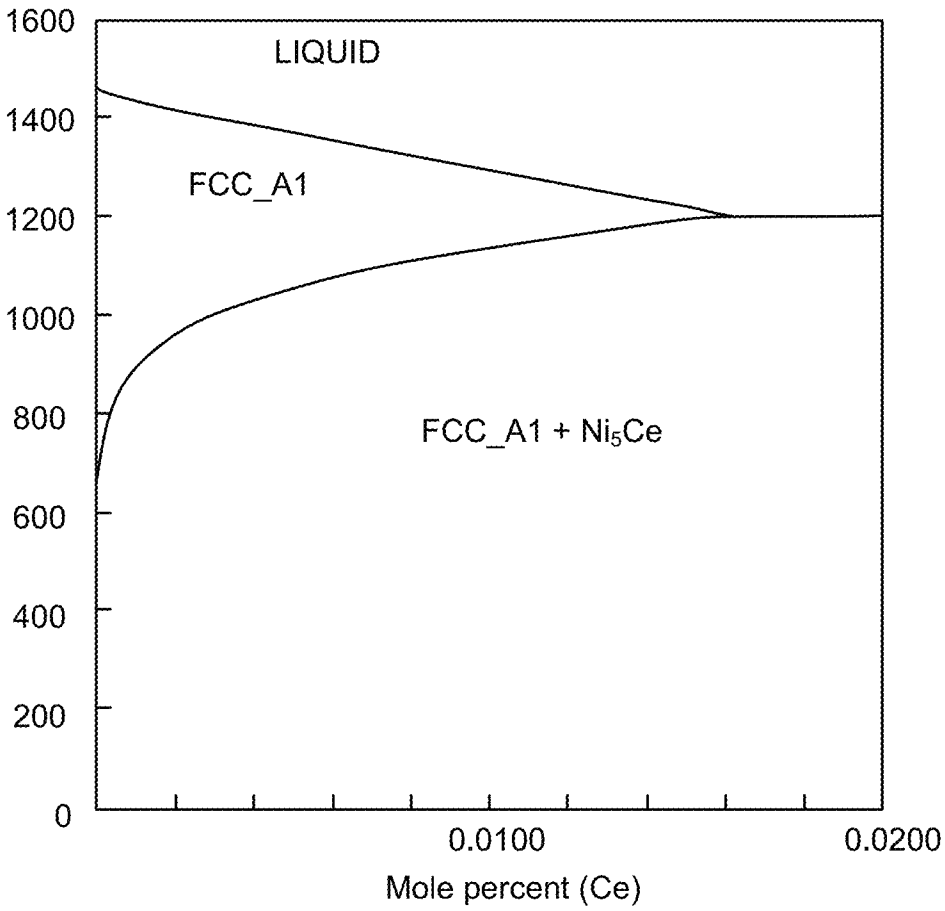
FIG. 5 is a NiCe phase diagram from Calculation of Phase Diagrams (CALPHAD) low Ce range.
Figure 7:
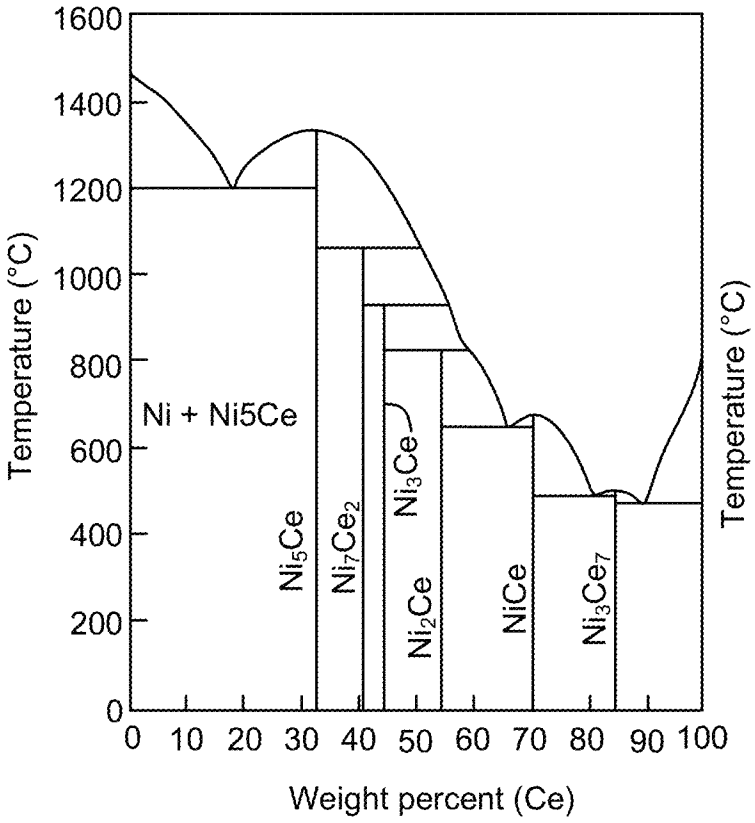
FIG. 7 is a NiCe phase diagram.

Computational NiCe phase diagrams were generated (see FIGS. 5 and 7). The NiCe phase diagrams show a solubility of Ce in the Ni solid solution that is near zero. These aspects of the phase diagrams lead to the following fabrication and design advantages: 1) general castability of eutectic alloys, 2) ideal hard particle volume fraction (5-20 vol %) for strengthening while retaining ductility, and 3) essentially nonexistent solubility of alloying element (Ce) in the matrix phase resulting in "kinetically trapped" and, thus, thermally stable hard particles. For hypoeutectic compositions (e.g., less than 8.3 at. % Ce), the ideal hard particle volume fraction may be between greater than 0 and about 50 mole percent of $Ni_5Ce$. For hypereutectic compositions (8.3-16.67 at. % Ce), the ideal hard particle volume fraction may be between about 50 and about 100 mole percent of precipitates.

The cast alloy compositions, according to some approaches, comprise a fine microstructure resulting from high conventional cooling rates (about 10° C./s). Under very rapid cooling rates (about $10^{4}$° C./s to about $10^{8}$° C./s) the eutectic morphology can be suppressed, enabling formation of distinct phases with other alloying components. Nucleation is enhanced to produce a finer structure due to interactions with heterogenous inoculation interfaces. In one such example the chemical interaction between the alloy and the mold produce a microstructural refinement through reduction of interface energy. In one example, Ce reacts with Cu, Si, Ti, and other transition metal additions that comprise a multi-component system with majority factions of Ni—Ce—Al with minor factions containing Ti, Si, and Cu.

Figure 6:
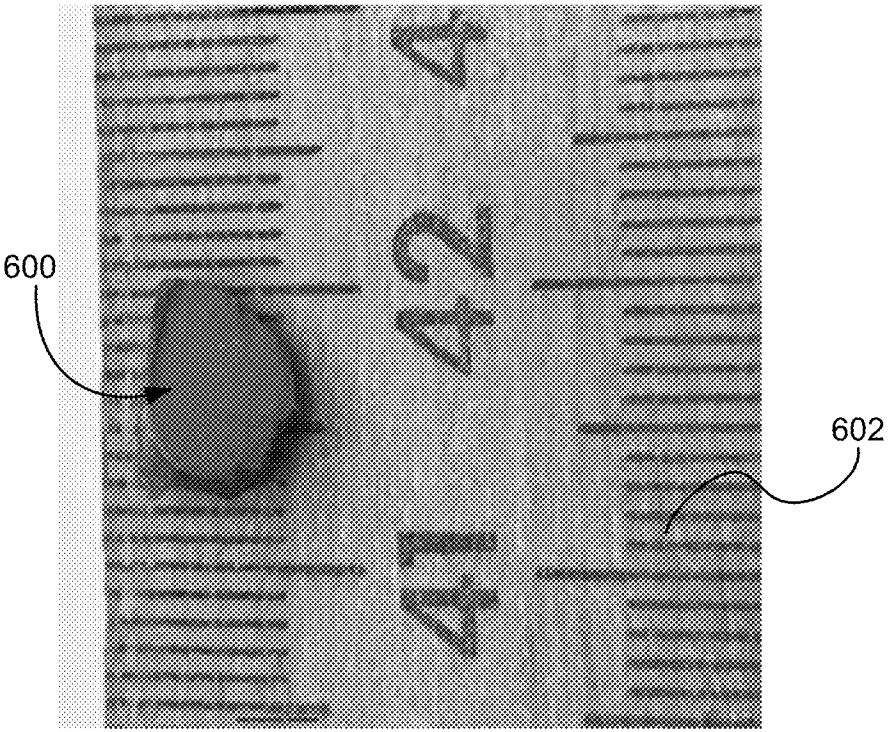
FIG. 6 is an image of a NiCe arc melted sample.

FIG. 6 is an exemplary image of a NiCe arc-melted sample 600 formed according to one of the approaches described herein. The sample 600 is shown resting on a ruler 602 in cm scale.

FIG. 7 is a NiCe phase diagram.

Figure 8:
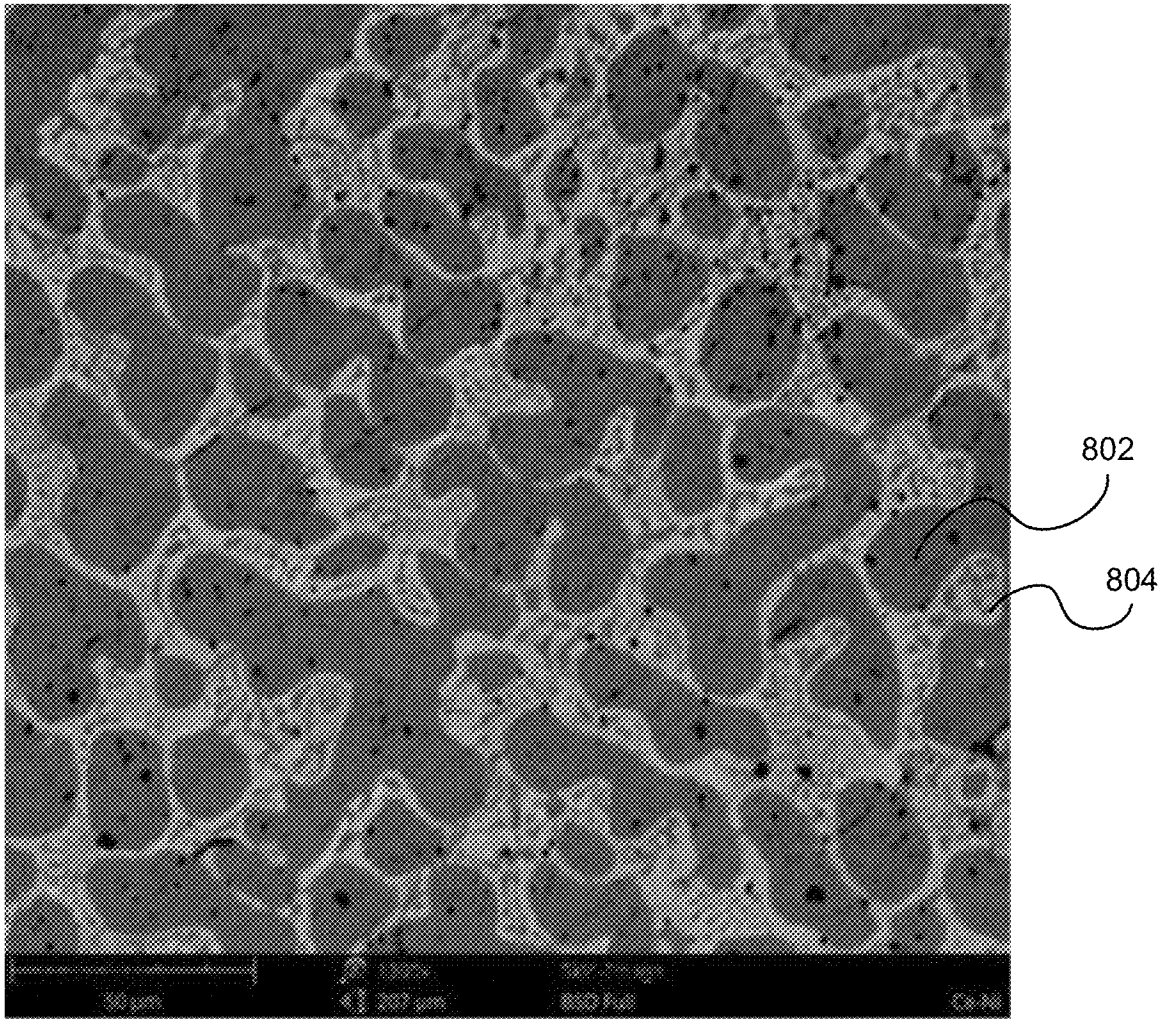
FIG. 8 is a micrograph of an exemplary NiCe alloy.

FIG. 8 is a micrograph 800 showing the details the microstructure of a hypoeutectic NiCe alloy as cast, with $Ni_5Ce$+FCC eutectic microstructure in a Ni matrix. This microstructure remains unchanged with little to no coarsening taking place after a heat treatment of 100 hours at 800° C. Vickers hardness testing showed the dendritic phase 802 comprising Ni (the darker phase) has a hardness of 128 HV while the intermetallic phase 804 comprising $Ni_5Ce$ (the brighter phase) region exhibited 212 HV, showing that the formation of the intermetallic strengthens the alloy (as compared to pure Ni with a hardness of about 65 HV).

In Use

High temperature heat exchangers require a large number of manufacturing steps, complex designs, welding, etc. To reduce the cost and complexity of manufacturing heat exchangers, nickel-rare earth element (REE) alloys, as presented herein, were developed as a less expensive alternative to standard high temperature and pressure materials. Aluminum-cerium (Al—Ce) alloys have been developed with increased high temperature properties as compared to other Al alloys. The presently disclosed Ni-REE alloys exhibit improved high temperature properties, particularly Ni—Ce alloys. These Ni-REE alloys provide competitive and improved performance compared to existing Ni-based superalloys.

Ni-REE alloys may be used commercially in transportation, electricity, generation, and industrial sectors, and/or wherever there is a need for high temperature functionality and pressure resistance. With improvement to alloy composition and manufacturing efficiency, cast Ni-REE heat exchangers are a cost effective alternative to conventional high temperature heat exchangers that require complex and costly manufacturing techniques. The Ni-REE alloys presented herein may be used in current and future high temperature and high pressure applications in the aerospace and power generation industries.

Additional high temperature applications for the Ni-REE alloys presented herein include turbine blades in jet engines, gas turbines, turbochargers, combustion chambers, exhaust systems, control surfaces, leading edges, reaction vessels, power generation, steam turbines, diverters, diverse nozzles, solar thermal collection, high temperature wiring, hypersonic structures, etc.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A product, comprising a material having:

nickel; and at least one rare earth element, wherein the at least one rare earth element is present in the material in a weight percentage in a range of about 2% to about 20% relative to a total weight of the material, wherein the material is characterized as having a feature selected from the group consisting of: dendrites in the material with an average spacing between the dendrites in a range of about 0.5 microns to about 30 microns, cellular dendrites in the material with an average spacing between the cellular dendrites in a range of about 0.05 microns to about 2 microns, and disconnected rare-earth-containing intermetallic particles in the material with an average intermetallic particle spacing in a range of about 0.05 microns to about 5 micron.

2. The product of claim 1, wherein the material is characterized as having the dendrites and/or the cellular dendrites in the material.

3. The product of claim 1, wherein the material is characterized as having the disconnected rare-earth-containing intermetallic particles in the material.

4. The product of claim 1, wherein the material is characterized as retaining greater than 50% of the material's mechanical properties at 1000° C.

5. The product of claim 1, wherein the at least one rare earth element is cerium (Ce).

6. The product of claim 1, wherein the at least one rare earth element is selected from the group consisting of: cerium (Ce), scandium (Sc), yttrium (Y), lanthanum (La), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

7. The product of claim 1, wherein the material comprises at least two rare earth elements.

8. The product of claim 1, wherein the material comprises at least one additional element selected from the group consisting of:

greater than 0% to about 40% iron (Fe) relative to a total weight of the material, greater than 0% to about 22% chromium (Cr) relative to a total weight of the material, greater than 0% to about 6% niobium (Nb) relative to a total weight of the material, greater than 0% to about 8% titanium (Ti) relative to a total weight of the material, greater than 0% to about 8% vanadium (V) relative to a total weight of the material, greater than 0% to about 15% aluminum (Al) relative to a total weight of the material, greater than 0% to about 8% molybdenum (Mo) relative to a total weight of the material, greater than 0% to about 6% manganese (Mn) relative to a total weight of the material, greater than 0% to about 6% tungsten (W) relative to a total weight of the material, greater than 0% to about 6% tantalum (Ta) relative to a total weight of the material, greater than 0% to about 6% rhenium (Re) relative to a total weight of the material, greater than 0% to about 6% ruthenium (Ru) relative to a total weight of the material, greater than 0% to about 18% cobalt (Co) relative to a total weight of the material, greater than 0% to about 0.2% carbon (C) relative to a total weight of the material, greater than 0% to about 2% boron (B) relative to a total weight of the material, greater than 0% to about 2% hafnium (Hf) relative to a total weight of the material, greater than 0% to about 2% zirconium (Zr), greater than 0% to about 2% scandium (Sc) relative to a total weight of the material, and greater than 0% to about 18% platinum (Pt) relative to a total weight of the material.

9. A product, comprising a material having:

nickel; and at least one rare earth element, wherein the at least one rare earth element is present in the material in a weight percentage in a range of about 2% to about 20% relative to a total weight of the material, wherein the material is characterized as having a structure including a gamma prime phase characteristic of a reaction of the nickel with aluminum and/or titanium, wherein the gamma prime phase is in a phase mol % of about 0.5 mol % to about 15 mol % of the material.

10. A method, comprising:

forming a material comprising an alloy of nickel and at least one rare earth element, wherein the at least one rare earth element is present in the material in a weight percentage in a range of about 2% to about 20% relative to a total weight of the material, wherein the forming includes a technique selected from the group consisting of: a rapid solidification technique, a casting technique, a coating technique, and a wrought technique, wherein the material is characterized as having a feature selected from the group consisting of: dendrites in the material with an average spacing between the dendrites in a range of about 0.05 microns to about 30 microns, cellular dendrites in the material with an average spacing between the cellular dendrites in a range of about 0.05 microns to about 2 microns, and disconnected rare-earth-containing intermetallic particles in the material with an average intermetallic particle spacing in a range of about 0.05 microns to about 5 micron.

11. The method of claim 10, wherein the forming includes the rapid solidification technique, the rapid solidification technique being selected from the group consisting of: selective laser melting, additive manufacturing and gas atomization.

12. The method of claim 10, wherein the forming includes the casting technique, the casting technique being selected from the group consisting of: sand casting, investment casting, and directional solidification.

13. The method of claim 10, wherein the forming includes the wrought technique, the wrought technique being selected from the group consisting of: extrusion and forging.

14. The method of claim 10, where the forming includes the coating technique, the coating technique being selected from the group consisting of: thermal spray, cold spray, physical vapor deposition, and pack cementation.

15. The method of claim 10, wherein the forming includes heating the nickel and the at least one rare earth element to form a liquified alloy of the nickel and the at least one rare earth element.

16. The method of claim 15, wherein the forming includes cooling the material at a rate of less than about 500 K/s after the heating for forming domains in the material, wherein an average size of the domains is in a range of about 0.5 microns to about 30 microns.

17. The method of claim 15, wherein the forming includes cooling the material at a rate of greater than about 500 K/s after heating to form the cellular dendrites in the material.

18. The method of claim 10, wherein the at least one rare earth element is cerium (Ce).

19. The method of claim 10, wherein the at least one rare earth element is selected from the group consisting of: cerium (Ce), scandium (Sc), yttrium (Y), lanthanum (La), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

20. The method of claim 10, wherein the material comprises at least two rare earth elements.

21. The method of claim 10, wherein the material comprises at least one additional element selected from the group consisting of:

greater than 0% to about 40% iron (Fe) relative to a total weight of the material,
greater than 0% to about 22% chromium (Cr) relative to a total weight of the material,
greater than 0% to about 6% niobium (Nb) relative to a total weight of the material,
greater than 0% to about 8% titanium (Ti) relative to a total weight of the material,
greater than 0% to about 8% vanadium (V) relative to a total weight of the material,
greater than 0% to about 15% aluminum (Al) relative to a total weight of the material,
greater than 0% to about 8% molybdenum (Mo) relative to a total weight of the material,
greater than 0% to about 6% manganese (Mn) relative to a total weight of the material,
greater than 0% to about 6% tungsten (W) relative to a total weight of the material,
greater than 0% to about 6% tantalum (Ta) relative to a total weight of the material,
greater than 0% to about 6% rhenium (Re) relative to a total weight of the material,
greater than 0% to about 6% ruthenium (Ru) relative to a total weight of the material,
greater than 0% to about 18% cobalt (Co) relative to a total weight of the material,
greater than 0% to about 0.2% carbon (C) relative to a total weight of the material,
greater than 0% to about 2% boron (B) relative to a total weight of the material,
greater than 0% to about 2% hafnium (Hf) relative to a total weight of the material,
greater than 0% to about 2% zirconium (Zr),
greater than 0% to about 2% scandium (Sc) relative to a total weight of the material, and
greater than 0% to about 18% platinum (Pt) relative to a total weight of the material.

22. The product of claim 9, wherein the material comprises at least one additional element selected from the group consisting of:

greater than 0% to about 40% iron (Fe) relative to a total weight of the material,
greater than 0% to about 22% chromium (Cr) relative to a total weight of the material,
greater than 0% to about 6% niobium (Nb) relative to a total weight of the material,
greater than 0% to about 8% titanium (Ti) relative to a total weight of the material,
greater than 0% to about 8% vanadium (V) relative to a total weight of the material,
greater than 0% to about 15% aluminum (Al) relative to a total weight of the material,
greater than 0% to about 8% molybdenum (Mo) relative to a total weight of the material,
greater than 0% to about 6% manganese (Mn) relative to a total weight of the material,
greater than 0% to about 6% tungsten (W) relative to a total weight of the material,
greater than 0% to about 6% tantalum (Ta) relative to a total weight of the material,
greater than 0% to about 6% rhenium (Re) relative to a total weight of the material,
greater than 0% to about 6% ruthenium (Ru) relative to a total weight of the material,
greater than 0% to about 18% cobalt (Co) relative to a total weight of the material,
greater than 0% to about 0.2% carbon (C) relative to a total weight of the material,
greater than 0% to about 2% boron (B) relative to a total weight of the material,
greater than 0% to about 2% hafnium (Hf) relative to a total weight of the material,
greater than 0% to about 2% zirconium (Zr),
greater than 0% to about 2% scandium (Sc) relative to a total weight of the material, and
greater than 0% to about 18% platinum (Pt) relative to a total weight of the material.

* * * * *